US006065985A

United States Patent [19]

Marshall

[11] Patent Number: 6,065,985

[45] Date of Patent: May 23, 2000

[54] MODULAR JACK WITH FLEXIBLE SHORTING STRUCTURE

[75] Inventor: Robert E. Marshall, Elizabethtown, Pa.

[73] Assignee: Berg Technology, Inc., Reno, Nev.

[21] Appl. No.: 09/172,285

[22] Filed: Oct. 14, 1998

[51] Int. Cl.[7] ..... H01R 29/00

[52] U.S. Cl. ..... 439/188; 200/51.1

[58] Field of Search ..... 439/188, 607, 439/425, 676; 200/51.1; 174/34

[56] References Cited

U.S. PATENT DOCUMENTS

| | | | |
|---|---|---|---|
| 4,202,593 | 5/1980 | Abernethy et al. | 439/125 |
| 4,412,715 | 11/1983 | Bogese, II | 339/97 P |
| 4,418,239 | 11/1983 | Larson et al. | 174/34 |
| 4,477,134 | 10/1984 | Wirght | 339/17 F |
| 4,863,393 | 9/1989 | Ward et al. | 439/188 |
| 4,874,333 | 10/1989 | Reed | 439/514 |
| 4,971,568 | 11/1990 | Cronin | 439/188 |
| 5,123,854 | 6/1992 | Petersonm et al. | 439/188 |
| 5,131,865 | 7/1992 | Taguchi et al. | 439/489 |
| 5,314,346 | 5/1994 | Owens et al. | 439/189 |
| 5,542,853 | 8/1996 | Bouchan | 439/188 |
| 5,790,660 | 8/1998 | Vlaeminck | 379/442 |

*Primary Examiner*—Neil Abrams
*Assistant Examiner*—Brian S. Webb
*Attorney, Agent, or Firm*—Daniel J. Long; Brian J. Hamilla; M. Richard Page

[57] ABSTRACT

A modular jack assembly with a flexible shorting bar having a first longitudinal insulative strip and a second longitudinal insulative strip. A plurality of insulative spaced parallel transverse strips is interposed between the first and second longitudinal strips forming a plurality of transverse openings between the first and second longitudinal strip. The shorting bar also includes at least one conductive trace having a pair of transverse conductive legs and connecting longitudinal section. Each of the transverse conductive legs is superimposed over a separate one of the transverse strips, and the longitudinal conductive section is superimposed over one of the longitudinal strips. This flexible shorting bar is superimposed over the medial interior wall of the housing such that the transverse strips are each positioned in a separate one of said contact receiving recesses.

23 Claims, 6 Drawing Sheets

MODULAR JACK WITH FLEXIBLE SHORTING STRUCTURE

BACKGROUND OF THE INVENTION

1. Field of the Invention

The present invention relates to electrical connectors and more particularly to modular jacks with shorting bars.

2. Brief Description of Earlier Developments

Many electronic devices are designed to accept one or more plugs. Having integrated circuits to enhance the flexibility or the capability of the device. Such modules may be susceptible to damage from electrostatic discharges experienced in handling. Such electrostatic discharges may result in damage to the integrated circuit.

The use of shorting bars in modular jacks to prevent such discharges is known in the art. There is, however, a need for a shorting structure which allows two or more shorting circuits to be used on the same jack. There is also a need for such a shorting structure that can be used to modify an already existing jack.

SUMMARY OF THE INVENTION

The present invention is a modular jack assembly which includes an outer insulative housing having top and bottom walls and opposed lateral walls. The housing has an interior section and also having first and second open ends. In the interior section there is an interior medial wall extending from the bottom wall toward the top wall having an upper terminal edge in spaced relation from the upper wall. A plurality of spaced vertical interior medial wall extensions extend upwardly from said upper edge to form a plurality of contact receiving recesses. Each of these recesses is interposed between adjacent interior medial wall extensions.

There is also a flexible shorting bar having a first longitudinal insulative strip and a second longitudinal insulative strip. A plurality of insulative spaced parallel transverse strips is interposed between the first and second longitudinal strips forming a plurality of transverse openings between the first and second longitudinal strip. The shorting bar also includes at least one conductive trace having a pair of transverse conductive legs and connecting longitudinal section. Each of the transverse conductive legs in this pair is superimposed over a separate one of the transverse strips, and the longitudinal conductive section is superimposed over one of the longitudinal strips. This flexible shorting means is superimposed over the medial interior wall of the housing such that the transverse strips are each positioned in a separate one of said contact receiving recesses. The modular jack also includes a first plurality of generally parallel conductive contacts first extending generally from adjacent the bottom wall of the insulative housing across the second end of the housing to the top wall and then generally horizontally toward the first end of the housing. The conductive contacts then extend obliquely toward the second end of the housing such that each of said conductive contacts is positioned in one of said contact receiving recesses on the interior medial wall.

BRIEF DESCRIPTION OF THE DRAWINGS

The present invention is further described with reference to the accompanying drawings in which.

DETAILED DESCRIPTION OF THE PREFERRED EMBODIMENTS

Figure 2:
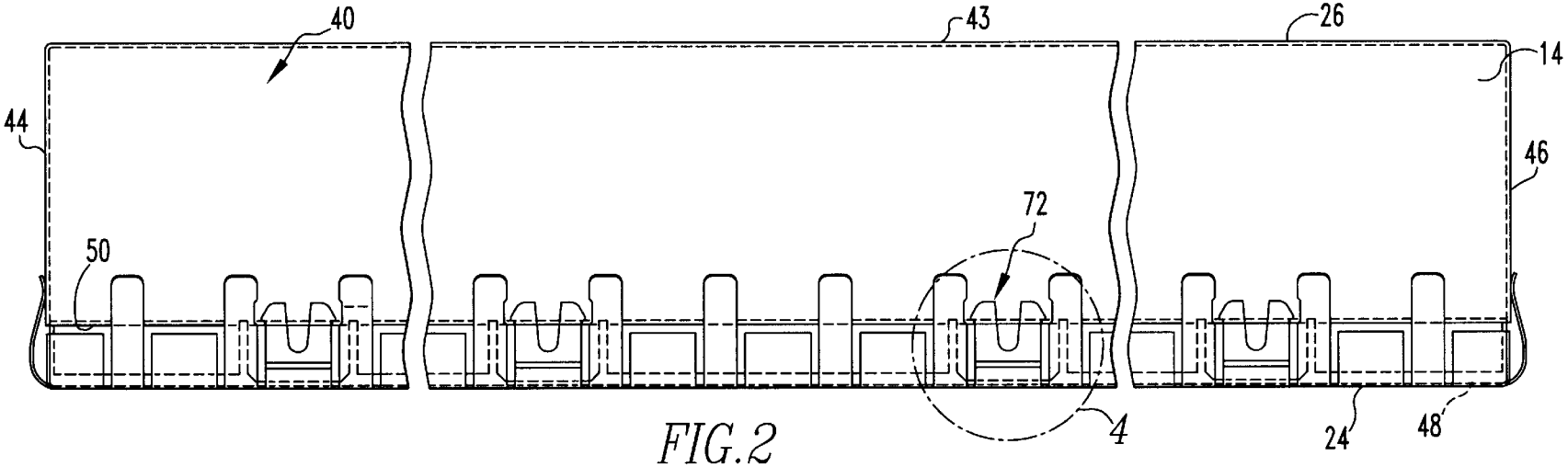
FIG. 2 is a top plan view of the modular gang jack shown in FIG. 1.
Figure 1:
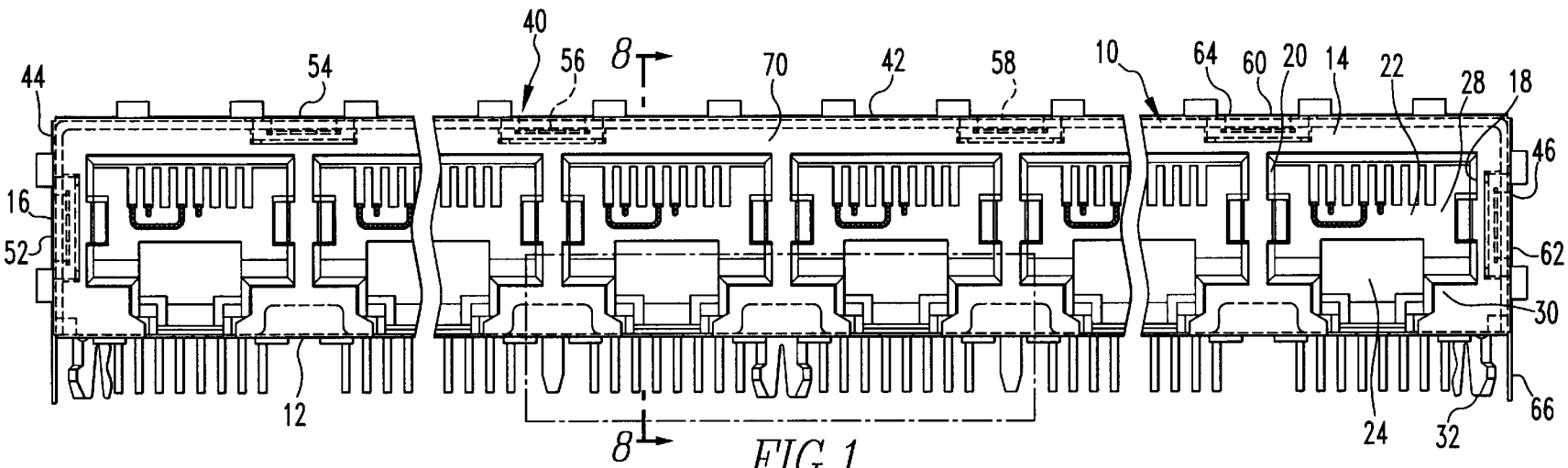
FIG. 1 is a modular gang jack representing a preferred embodiment of the present invention.
Figure 3:
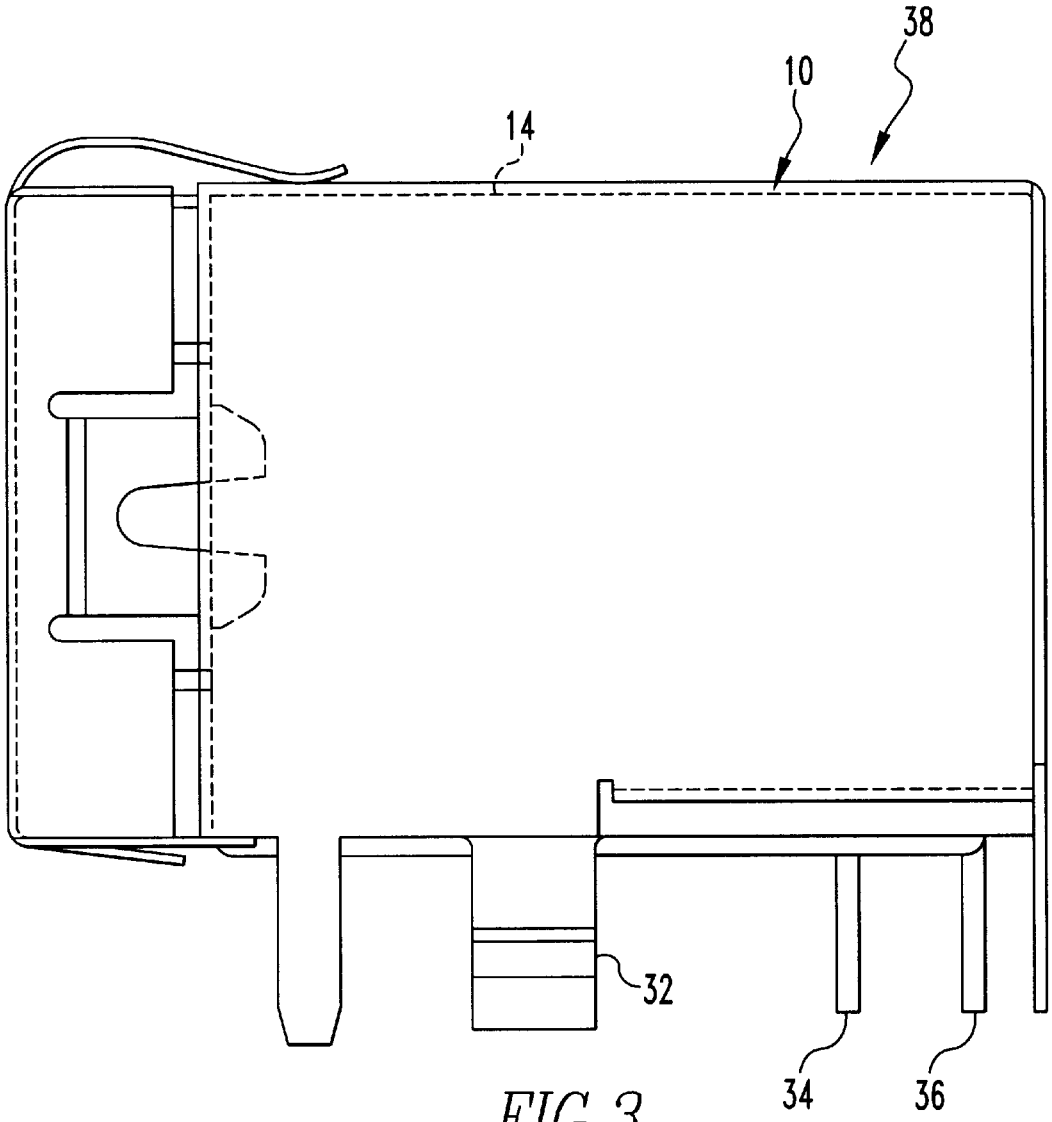
FIG. 3 is an end view of the modular gang jack shown in FIG. 1.
Figure 4:
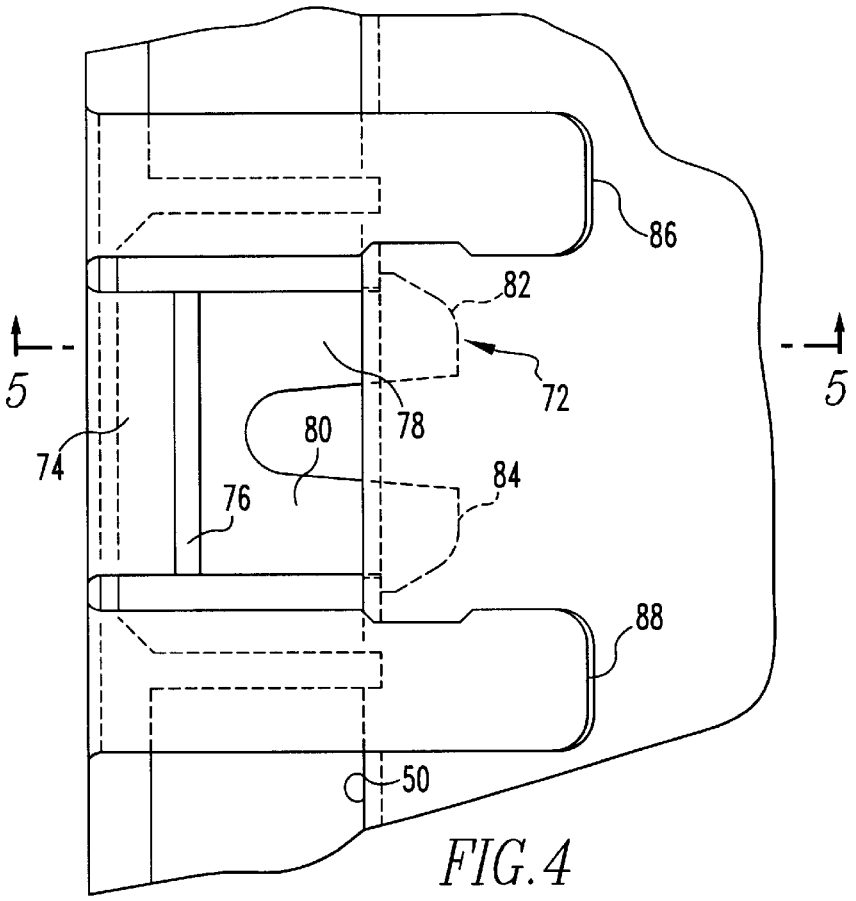
FIG. 4 is an enlarged view of the area in circle 4 in FIG. 2.

Referring to FIGS. 1–5, the modular jack of the present invention includes an insulative housing shown generally at numeral 10. This housing includes a lower horizontal longitudinal wall 12 and an upper horizontal longitudinal wall 14. The housing also includes end lateral walls 16 and 18 as well as a plurality of intermediate lateral walls as at 20. Adjacent lateral walls as at 18 and 20 form plug receiving cavities as at 22. Each of these plug receiving cavities has a front open end 24 and a rear end 26. In each plug receiving cavity there is a medial wall 28 and steps as at 30 to form a key structure. The modular jack also includes mounting pins as at 32 and conductive terminals as at 34 and 36. The modular jack also includes a metallic shield shown generally at numeral 38. The metallic shield includes a first lateral member shown generally at 40 which has a horizontal wall 42 which is superimposed over upper horizontal wall 14 of the insulated housing. The first lateral member 40 also includes a rear vertical wall 43 superimposed over rear end 26 and a lateral vertical wall 44 which is superimposed over lateral wall 16 of the insulated housing and lateral vertical wall 46 which is superimposed over lateral wall 18 of the insulated housing. The first lateral member of the shield has a front peripheral edge 48, and rearwardly spaced from this edge there is a peripheral step 50. At spaced peripheral intervals there are additional deeper recesses, 52, 54, 56, 58, 60 and 62. Each of those recesses has an engagement aperture as at aperture 64 in recess 60. The first lateral member of the shield also includes grounding pins such as pin 66. The shield also includes a second vertical member which is shown generally at numeral 70. This second vertical member of the shield is engaged to the first lateral member of the shield by a system of clips which is explained as follows.

There are a number of first recess engaging clips shown generally at numeral 72. Each of these recess engaging clips includes a rearward extension 74, a downward oblique section 76 and a pair of rearwardly extending legs 78 and 80 which have, respectively, rearward outwardly extending projections 82 and 84. These legs pass through recess apertures as at aperture 64 and the projections 82 and 84 grasp the edges of the apertures. Outwardly adjacent each of the recess engaging clips there are a pair of generally horizontal tabs as at 86 and 88.

Figure 5:
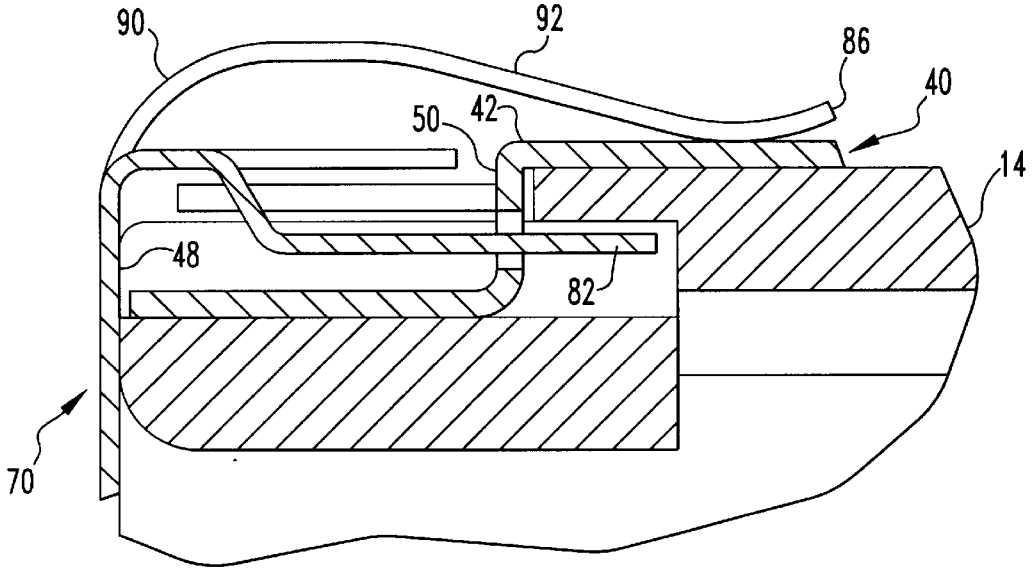
FIG. 5 is a cross section through 5—5 in FIG. 4.

Referring particularly to FIG. 5, it will be seen that each of these tabs has an upwardly and rearwardly curved section 90 and then a downwardly and rearwardly curved section 92 which abuts the first lateral section 40 of the shield. As is further explained in U.S. Pat. No. 5,788,538, the contents of which are incorporated herein by reference. Outwardly adjacent the horizontal tabs as at 86 and 88 there are a pair of generally vertical tabs (not shown) may be employed. These sets of tabs may be used at spaced intervals along the peripheral edge 48 of the first member to effectively seal the modular jack from EMI. The use of multiple tabs also serves to effectively ground the shield and the modular jack.

It will be seen that the front section 70 of the shield is also engaged to the lower longitudinal wall 12 by means of lower horizontal clips (not shown) which is disclosed in U.S. Pat. No. 5,788,538. As is also further disclosed in U.S. Pat. No. 5,788,538, it will be appreciated that the modular jack is engaged with a panel (not shown) that the second horizontal clips as at 86 will be flexed by the lower edge of the panel from the relaxed position. It will also be appreciated that the generally vertical tabs as at 94 will engage the rear side of a panel to firmly engage the panel and allow for effective shielding of the modular jack.

Figure 7:
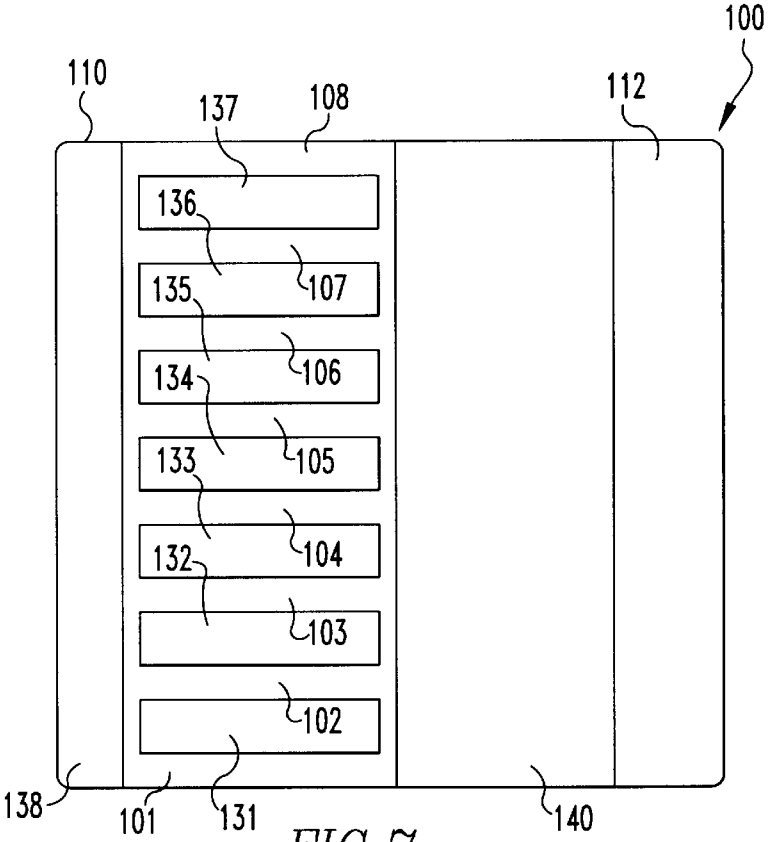
FIG. 7 is a bottom plan view of the flexible circuit shorting bar shown in FIG. 6.
Figure 6:
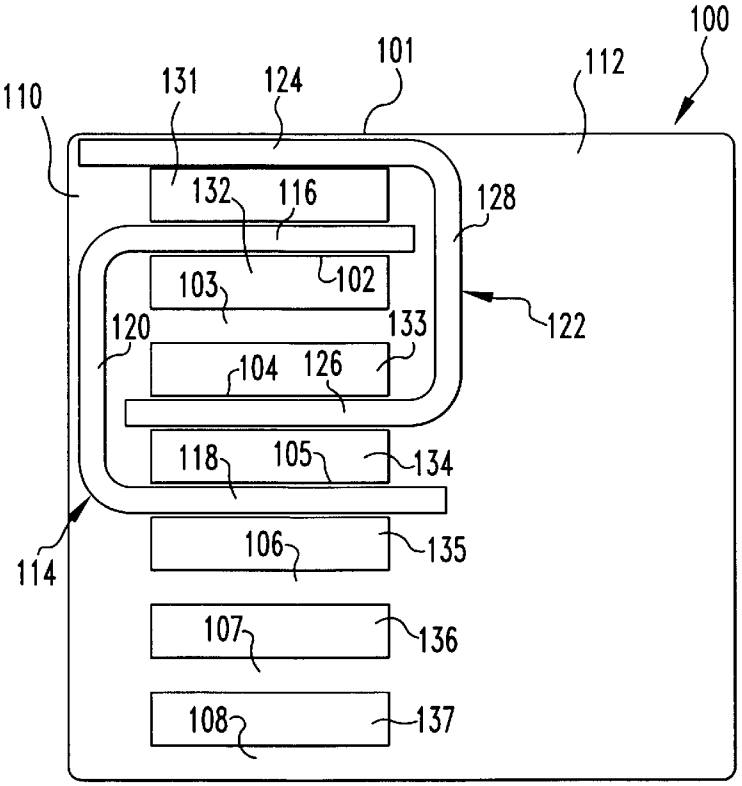
FIG. 6 is a top plan view of a flexible circuit shorting bar used in the modular jack shown in FIG. 1.

Referring to FIGS. 6 and 7, the flexible shorting bar used in the modular jack of the present invention is shown generally at numeral 100. This flexible shorting bar includes a single polymeric membrane which has transverse strip 101–108 and a front longitudinal strip 110 and 112. Preferably the material of this strip is a polyimide, or a polyester material, having a thickness of about 0.001 in. Superimposed on this membrane there is a first U-shaped conductive trace 114 which includes a pair of transverse legs 116 and 118 and a longitudinal leg 120 connecting the transverse legs. Transverse leg 116 is superimposed on transverse strip 102 and transverse leg 118 is superimposed on transverse strip 105. The longitudinal leg 120 is superimposed on the front longitudinal strip 110. Preferably this trace is comprised of about 1 ounce of copper. The flexible shorting bar 100 also includes a second conductive trace 122 comprised of a transverse leg 124 superimposed on transverse strip 101 and transverse leg 126 superimposed on transverse strip 104 with a longitudinal leg 128 superimposed on the rear longitudinal strip 112 connecting the transverse legs. Between the transverse strips there are apertures 131–137 the function of which is explained below. On the bottom side of the front longitudinal strip 110 there is a front adhesive backing 138. On the bottom side of the rear longitudinal strip 112 there is a rear adhesive backing 140.

Figure 8A:
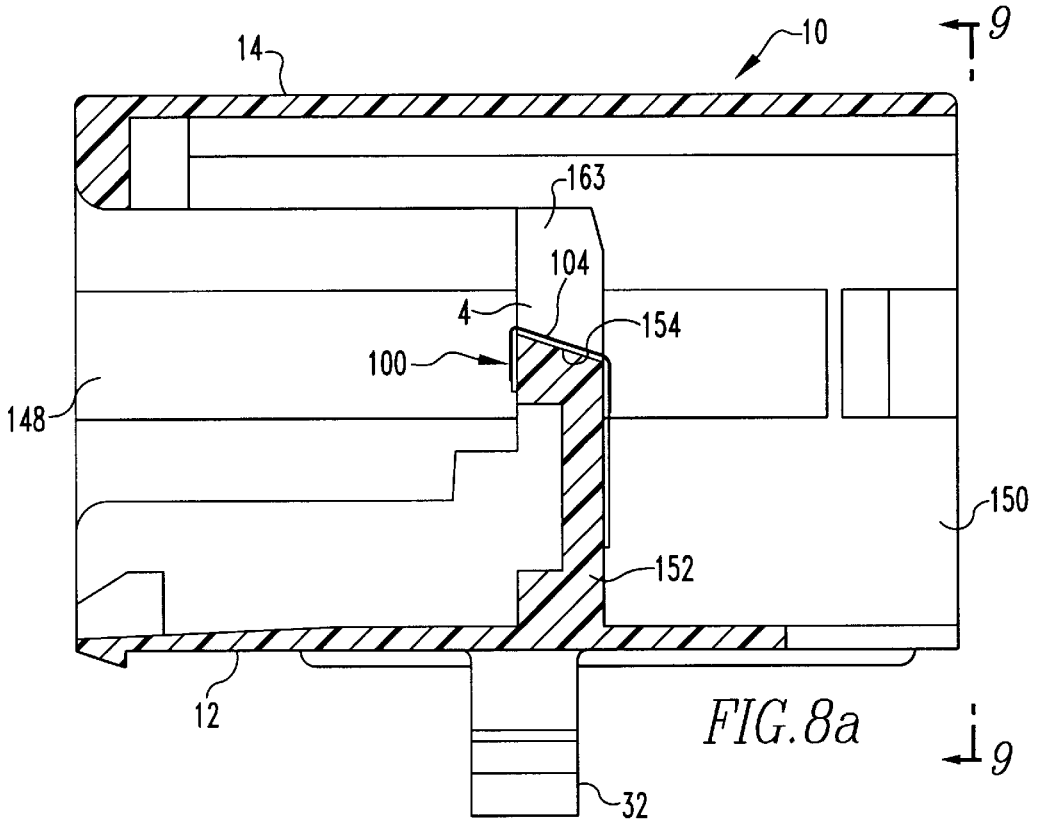
FIGS. 8*a* and 8*b* are cross sectional views through 8—8 in FIG. 1 shown respectively with and without rear insulative inserts.
Figure 9:
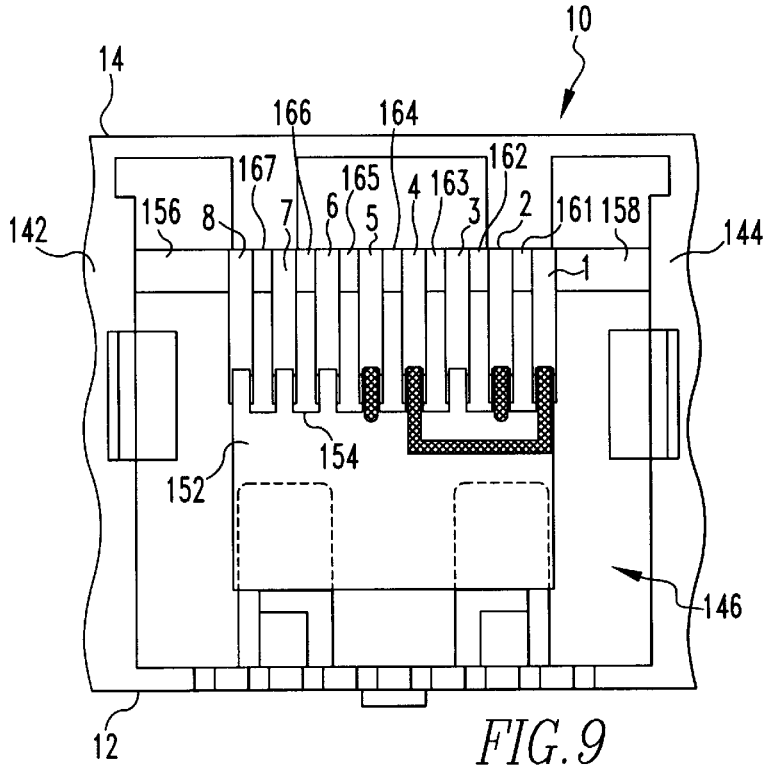
FIG. 9 is a back view from 9—9 in FIG. 8*a* showing the positioning of the flexible circuit shorting bar.

Referring to FIGS. 8 and 9, on the opposed sides of each port there are lateral walls 142 and 144 which form with the upper and lower walls and interior section 146. The interior section has a front open end 148 and a rear open end 150. In this interior section an interior medial wall 152 similar to wall 22 extends upwardly from the lower wall. This interior medial wall has an upper terminal edge 154 from which lateral extensions 156 and 158 protrude. Between the lateral extensions 156 and 158 there are a plurality of medial wall extensions 161–167. Between these medial extensions 161–167 eight contact receiving recesses 1–8 are formed. Covering the rear open end of the housing there is an insulative insert 168. This insulative insert includes a vertical base section 170 and a horizontal section 172 which projects into the interior section 146 of the housing. The insulative insert 168 also supports eight contacts as at contact 174. Each of these contacts extends upwardly from the base of the insert in vertical section 176 and then forward in a horizontal section 180 to the forward terminal end of horizontal projection 172. From this point they each extend downwardly and rearwardly in an oblique section 178 and come to rest in one of the recesses 1–8 which, as is conventional each contact being received in a single recess.

Referring again to FIG. 6 as well as to FIGS. 8 and 9, it will be appreciated that the contact in recess 1 will be superimposed on transverse leg 124 of conductive trace 122 and the contact in recess 4 will be superimposed on transverse leg 126 of conductive trace 122 so that there will be a short between contact pairs 1 and 4. It will also be seen that contact 2 will be superimposed on transverse leg 116 of conductive trace 114 while contact 5 will be superimposed in recess 5 on transverse leg 118 of the same conductive trace so that contact 2–5 will be shorted.

Figure 8B:
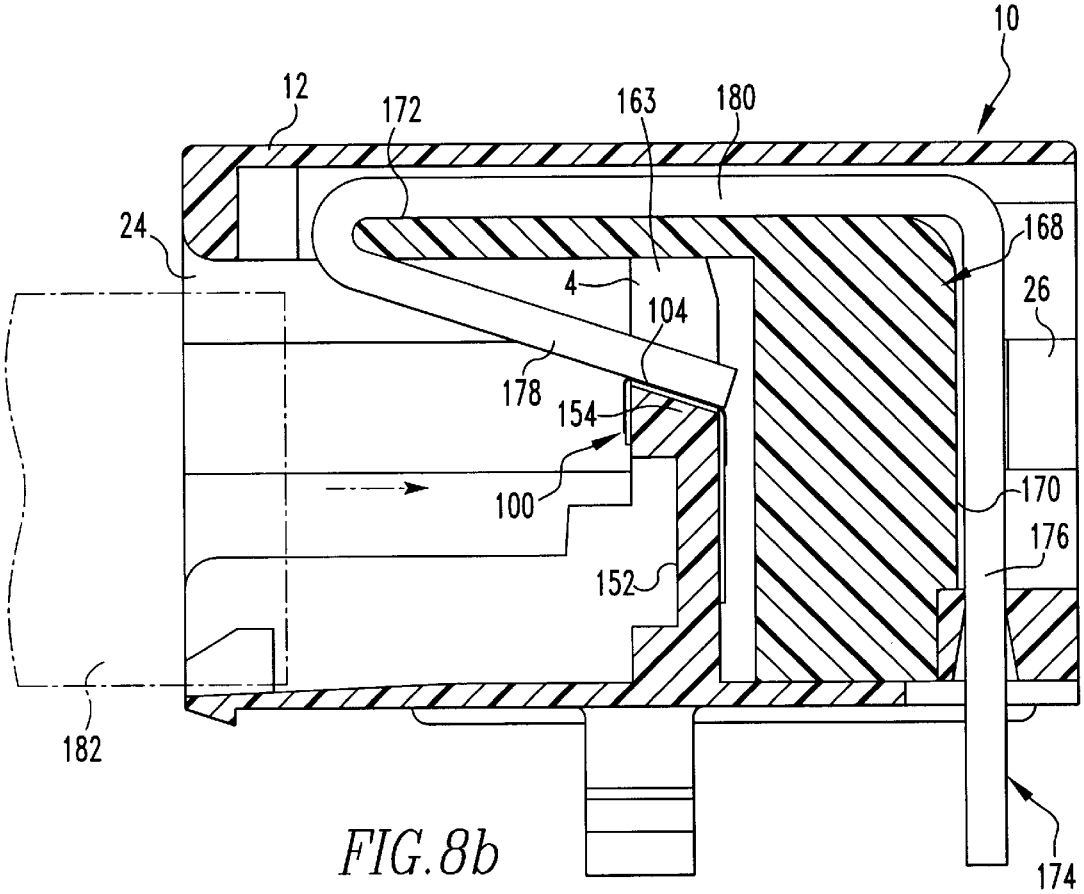

Referring particularly to FIG. 8*b* when a plug shown generally at numeral 182 is inserted the oblique sections of the contacts as at section 180 will be flexed upwardly from the recesses to remove these shorts. Thus the jack is only shorted when the plug has not been inserted.

It will be appreciated that the modular jack of the present invention has the following advantages:

A flex circuit is used to create the desired shorts.

No modification to the modular jack connector is required. Applying the flex to the existing housing prior to the insert sub-assembly creates the desired shorts.

The flex circuit is dropped over the internal housing webs and held in place by way of pressure sensitive adhesive applied to the back of the flex. The webs along with the square holes punched into the flex provide proper alignment between the connector leads and the metallized traces of the flex.

One flex circuit design can accommodate various short circuits as required. Only the art work needs to be altered for the different shorting requirements.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A modular jack assembly comprising:

(a) an outer insulative housing having top and bottom walls and opposed lateral walls forming an interior section and first and second ends and there being an interior medial wall extending from the bottom wall toward the top wall having an upper terminal edge in spaced relation from the upper wall and a plurality of spaced vertical interior medial wall extensions extending upwardly from said upper edge to form a plurality of contact receiving recesses each of which recesses is interposed between adjacent interior medial wall extensions;

(b) a flexible shorting means having a first longitudinal insulative strip and a second longitudinal insulative strip with a plurality of insulative spaced parallel transverse strips interposed between said first and second longitudinal strips forming a plurality of transverse openings between said first and second longitudinal strip and a conductive means having a pair of transverse conductive legs each of which pair of transverse conductive legs is superimposed over a separate one of said transverse strips and a longitudinal conductive section is superimposed over one of the longitudinal strips and connecting said pair of transverse conductive legs, and said flexible shorting means is superimposed over the medial interior wall such that the transverse strips are each positioned in a separate one of said contact receiving recesses on the interior medial wall of the outer insulative housing; and (c) a plurality of generally parallel conductive contacts first extending generally from adjacent the bottom wall of the insulative housing across the second end of the housing to the top wall and then generally horizontally toward the first end of the housing and then obliquely toward the second end of the housing such that each of said conductive contacts is positioned in one of said contact receiving recesses on the interior medial wall of the outer insulative housing.

2. The modular jack assembly of claim 1 wherein the longitudinal conductive section of the connecting means is superimposed over the first longitudinal strip of the flexible shorting means.

3. The modular jack assembly of claim 2 wherein the conductive means on the flexible shorting means is a first conductive means and there is a second conductive means having a longitudinal conductive section and a pair of conductive transverse legs each of which pair is superimposed over a separate one of said transverse strips not occupied by said first conductive means and the longitudinal conductive section of the second conductive means is superimposed over one of the longitudinal strips of the flexible shorting means.

4. The modular jack assembly of claim 3 wherein the longitudinal strip of the second conductive means is superimposed over the second longitudinal strip of the flexible shorting means.

5. The modular jack assembly of claim 4 wherein there are conductive contacts 1, 2, 3, 4, 5, 6, 7 and 8 which are positioned respectively in contact receiving recesses 1, 2, 3, 4, 5, 6, 7 and 8 and the transverse legs of the first conductive means are superimposed over the flexible insulative strips in recesses 2 and 5.

6. The modular jack assembly of claim 5 wherein the transverse legs of the second conductive means are superimposed over the flexible insulative strips in recesses 1 and 4.

7. The modular jack assembly of claim 4 wherein a single contact receiving recess is interposed between the recesses in which the pair of transverse legs in the first conductive means are positioned.

8. The modular jack assembly of claim 7 wherein one of the transverse legs in the second conductive means is positioned in the single contact receiving recess interposed between the recesses in which the pair of transverse legs in the first conductive means are positioned.

9. The modular jack assembly of claim 1 wherein the first and second longitudinal strips and the transverse strips are comprised of a flexible polymeric material.

10. The modular jack assembly of claim 9 wherein the polymeric material is selected from a polyester material and a polyimide material.

11. The modular jack assembly of claim 9 wherein the conductive means comprises a trace.

12. The modular jack assembly of claim 9 wherein an adhesive is interposed between the flexible shorting means and the interior medial wall.

13. The modular jack assembly of claim 12 wherein the first and second longitudinal strips of the flexible shorting means has an adhesive backing.

14. The modular jack assembly of claim 1 wherein one of the contacts bears against the conductive means.

15. The modular jack assembly of claim 3 wherein one of the contacts bears against the second conductive means.

16. The modular jack assembly of claim 1 wherein the first and second ends are open ends.

17. The modular jack assembly of claim 1 wherein the conductive contacts are retained in an insulative insert which is superimposed over at least part of the second open end.

18. The modular jack assembly of claim 14 wherein the longitudinal conductive section of the conductive means is superimposed over the first longitudinal strip of the flexible shorting means.

19. The modular jack assembly of claim 18 wherein the conductive means on the flexible shorting means is a first conductive means and there is a second conductive means having a longitudinal conductive section and a pair of conductive transverse legs each of which pair is superimposed over a separate one of said transverse strips not occupied by said first conductive means and the longitudinal conductive section of the second conductive means is superimposed over one of the longitudinal strips of the flexible shorting means.

20. The modular jack assembly of claim 19 wherein the polymeric material is selected from a polyester material and a polyimide material.

21. The modular jack assembly of claim 19 wherein the conductive means comprises a metallic trace.

22. A housing and shorting assembly for use in a modular jack:

(a) an outer insulative housing having top and bottom walls and opposed lateral walls forming an interior section and first and second ends and there being an interior medial wall extending from the bottom wall toward the top wall having an upper terminal edge in spaced relation from the upper wall and a plurality of spaced vertical interior medial wall extensions extending upwardly from said upper edge to form a plurality of contact receiving recesses each of which recesses is interposed between adjacent interior medial wall extensions; and (b) a flexible shorting means having a first longitudinal insulative strip and a second longitudinal insulative strip with a plurality of insulative spaced parallel transverse strips interposed between said first and second longitudinal strips forming a plurality of transverse openings between said first and second longitudinal strip and a conductive means having a pair of transverse conductive legs each of which pair of transverse conductive legs is superimposed over a separate one of said transverse strips and a longitudinal conductive section is superimposed over one of the longitudinal strips and connecting said pair of transverse conductive legs, and said flexible shorting means is superimposed over the medial interior wall such that the transverse strips are each positioned in a separate one of said contact receiving recesses on the interior medial wall of the outer insulative housing.

23. A flexible structure for use in a modular jack comprising a first longitudinal insulative strip and a second longitudinal insulative strip with a plurality of insulative spaced parallel transverse strips interposed between said first and second longitudinal strips forming a plurality of transverse openings between said first and second longitudinal strip and a conductive means having a pair of transverse conductive legs each of which pair of transverse conductive legs is superimposed over a separate one of said transverse strips and a longitudinal conductive section is superimposed over one of the longitudinal strips and connecting said pair of transverse conductive legs.

* * * * *